US007083169B2

(12) United States Patent
Collins

(10) Patent No.: US 7,083,169 B2
(45) Date of Patent: Aug. 1, 2006

(54) MATHEMATICAL GAME

(75) Inventor: Amy L. Tsui Collins, 5955 Girvin Dr., Oakland, CA (US) 94611

(73) Assignee: Amy L. Tsui Collins, Oakland, CA (US)

( * ) Notice: Subject to any disclaimer, the term of this patent is extended or adjusted under 35 U.S.C. 154(b) by 1 day.

(21) Appl. No.: 10/793,235

(22) Filed: Mar. 4, 2004

(65) Prior Publication Data

US 2005/0167923 A1 Aug. 4, 2005

Related U.S. Application Data

(60) Provisional application No. 60/541,475, filed on Feb. 2, 2004, provisional application No. 60/541,424, filed on Feb. 2, 2004.

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS

D300,231 S 3/1989 Hertzano
5,016,889 A * 5/1991 Moss et al. ..... 273/293
5,314,190 A * 5/1994 Lyons ..... 273/272
5,478,087 A * 12/1995 Dumisani ..... 273/272
5,799,943 A * 9/1998 Morgan ..... 273/272
5,820,125 A * 10/1998 Olsen ..... 273/248
5,963,371 A * 10/1999 Needham et al. ..... 359/464
6,003,869 A * 12/1999 Kuo ..... 273/292
6,343,790 B1 * 2/2002 Rhemm ..... 273/287
6,402,144 B1 * 6/2002 Ekberg ..... 273/239
6,581,937 B1 * 6/2003 Crisswell ..... 273/299
6,695,618 B1 * 2/2004 Donn ..... 434/209
6,705,614 B1 * 3/2004 Kyle ..... 273/292
6,824,136 B1 * 11/2004 Koopman ..... 273/146
6,905,122 B1 * 6/2005 Weigl et al. ..... 273/292

OTHER PUBLICATIONS

Rummikub game, available in stores such as ToysRUs. A copy of the package insert is attached.

* cited by examiner

*Primary Examiner*—Eugene Kim
*Assistant Examiner*—Dolores R. Collins
(74) *Attorney, Agent, or Firm*—Robins & Pasternak LLP

(57) ABSTRACT

A game is provided that includes a plurality of sets of tiles or cards or an electronic version thereof, where each tile or card contains a number, a letter of an alphabet, or a mathematical symbol or a symbol that can be used in a mathematical equation. Also provided is a method of playing this game by each player taking turns to lay down equations and a method of making the game set.

3 Claims, No Drawings

MATHEMATICAL GAME

PRIORITY

This application claims priority to provisional application entitled "A Mathematical Game," Application No. 60/541,475, filed Feb. 2, 2004, and provisional application entitled "A Chemistry/Physics Game," Application No. 60/541,424, filed Feb. 2, 2004, the contents of both of which are incorporated by reference in their entireties.

FIELD OF THE INVENTION

This application relates to the field of games, in particular, education games, such as a mathematical game, a science game including a biology game, a chemistry game, and a physics game.

BACKGROUND OF THE INVENTION

People, in particular, children and teenagers, can learn in the context of game playing. Games are typically more fun than studying. Thus, if educational materials can be put in the context of games, and the games can be played over and over again, it will create a fun environment for learning. In particular, if games are played between adults and children, the exercise will promote more interaction between them.

Further, strategy and problem-solving are important skills to acquire for work purposes. These skills can also be learned in the context of games. Additionally, games can be designed to be played in teams, thus fostering cooperation between players.

Moreover, games can be tailored or adapted to make them age-appropriate so that people of all ages can play including pre-schoolers, kindergarteners, children in elementary schools, middle schools, junior high schools, high schools, college as well as adults.

Thus, it will be very desirable to design an educational game, such as a mathematical game, that can help people learn outside of a school setting, to help them improve or acquire skills and knowledge, for example, in the fields of mathematics and science.

SUMMARY OF THE INVENTION

It is, therefore, one of the objects of the present invention to provide a game that is educational, that can be played by people of all ages, or that can be tailored to make it age appropriate.

It is another one of the objects of the present invention to provide a method for playing the foregoing game.

It is another one of the objects of the present invention to provide for a method of playing the game electronically, such as by accessing the game on the Internet or on a computer disk.

In accordance to one of the objects of the invention, there is provided a game set, where the game set contains a plurality of sets of tiles. In one embodiment of the invention, there is provided a first set of tiles where each tile contains a number or an alphabet, and a second set where each tile contains a symbol, such as a symbol that is useful in a mathematical equation. In one embodiment, the number is chosen from among: 0, 1, 2, 3, 4, 5, 6, 7, 8, 9 and 10. Optionally, the number can be any number between 0 and 100, or between 0 and 1000, or between 0 and 10,000. In another embodiment, the number is a fraction. For example, the fraction is chosen from among: ½, ⅓, ⅔, ¼, ¾, ⅕, ⅛, ⅜, ⅝, ⅞, and 1/10.

In accordance to another one of the objects of the invention, there is provided a game as above, where the symbol is a mathematical symbol and the mathematical symbol is chosen from among: a plus ("+") sign, a minus ("−") sign, a division symbol ("÷"), a multiplication symbol which can be represented by an x ("×") or an asterisk ("*"), an equal sign ("="), an open parenthesis ("("), a close parenthesis (")"), a first open bracket ("["), a first close bracket ("]"), a second open bracket ("{"), a second close bracket ("}"), a greater than symbol (">"), a smaller than symbol ("<"), a percentage symbol ("%"), a square root symbol ("√"), a dollar sign ("$"), a pound sign ("£"), a Euro sign ("€"), a Yen sign ("¥"), a cent sign ("¢") and a logarithmic sign ("log").

In accordance to another one of the objects, there is provided a game set as above, where the game set includes instructions for playing the game.

In accordance to a further one of the objects, there is provided a game as above containing a third set of tiles, where each tile in the third set contains a wild number, that is, the tile can represent any number.

In accordance to yet another one of the objects, there is provided a fourth set of tiles, where each tile in the fourth set contains a wild symbol, that is, the tile can represent any symbol, such as a symbol that is useful in a mathematical equation such as a function, operator or a notation that is useful in setting up a mathematical equation, including brackets.

In accordance to still another one of the objects, there is provided a fifth set of tiles, wherein each tile in the fifth set contains a number in superscript or a number in subscript. The number in superscript or subscript can be any number such as, for example, 1, 2, 3, 4, 5 or greater, such as 10.

In accordance to a further one of the objects of the invention, there is provided a sixth set of tiles, where each tile is blank.

In accordance to yet another one of the objects, there is provided a game set as above, where each tile is decorated. Such decoration can be decorations that appeal to children, teenagers or adults including, for example, dots, one or more fruits, vegetables, flowers, airplanes, cars, balloons, hearts, animals and the like as well as decorations suitable for different themes such as a 3-leaf clover celebration of the feast of St. Patrick, a turkey for celebration of Thanksgiving, a pumpkin for celebration of Halloween, Santa Claus or Christmas tree for celebration of Christmas, and a menorah for celebration of Hanukah. The decorations can be in one or more colors.

In accordance to another one of the objects, there is a game set as above, where the tile containing a number contains a number in Braille.

In accordance to a further one of the objects, there is provided a container for holding the game set.

In accordance to another one of the objects, there is provided a method for playing a mathematical game, where the method includes providing a game set as above and allowing the game to be played.

In accordance to yet another one of the objects, there is provided a software program, where the program is configured to allow the game as above to be played electronically, for example, through use of a computer, a disk, a CD, through Internet access or through a hand held or portable device such as a Palm Pilot, a cell phone and the like.

In accordance to a further object of the invention, there is provided a method of making a game set as above, comprising the steps of providing a mould for making a plurality of tiles and pouring a tile-making material into the mould. The tile-making material will be allowed to set to produce the tiles. The tile-making materials will be any suitable material for making the tiles, including, for example, glass, metal, alloy, ceramic, clay, plastic and other synthetic materials.

In accordance to another one of the objects, there is provided a method of making a game set as above, comprising creating a plurality of tiles out of tile-making materials, and printing a number or a symbol on each tile, where the tile-making material includes, for example, natural wood, engineered wood such as laminated wood or pressed wood, cardboard paper, shells, and bones.

In accordance to a further one of the objects, the method as above may optionally include assembling the tiles into a container, such as a box, including a cardboard box, a wooden box, a metal box, a box made of synthetic material, a leather box or any combination of such, or the container can be a bag such as a cloth bag made of cotton, woolen, leather, or other natural or synthetic material, or a pail.

Further objects, features, advantages and objects of the present invention will be apparent to those skilled in the art from consideration of the specification and practice of the invention disclosed herein. It is intended that the specification and examples herein be considered as exemplary only, with a true scope and spirit of the invention being indicated by the claims herein.

DETAILED DESCRIPTION OF THE INVENTION

The inventor herein has discovered a novel mathematical game that can be played by people of all ages that have an educational component and a fun component. The present invention provides for a game set that contains a plurality of sets of tiles or cards. For easy reference, all tiles and cards or other similar playing pieces will be referred to herein as tiles, with the understanding that the present game can be played in various forms, for example, tiles similar to the game of Mahjong or Rummikub or Scrabble and cards similar to conventional playing cards. Each tile of the invention contains a number, an alphabet, a symbol, a wild number (which can be played as any number), a wild symbol (which can be played as any symbol), a wild alphabet (which can be played as any alphabet), or the word "log." Optionally, the wild number or symbol or alphabet can be a blank tile.

In one embodiment of the present invention, the tiles are not decorated. In another embodiment, the tiles are decorated. The decoration includes any decoration, including those that appeal to young children, teenagers, or adults. For example, the decoration includes dots, one or more vegetables, one or more fruits, airplanes, cars, trucks, trains, robots, balloons, hearts, diamonds, spades, clubs, or other decorations commemorating an event. Such commemoration includes, for example, St. Patrick's day, such as represented by a 3-leaf clover; Valentine's day, such as represented by roses, angels, or hearts; Independence Day, such as represented by flags; Halloween, such as represented by pumpkins, witches, owls or bats; Thanksgiving, such as represented by turkeys or food; Christmas, such as represented by Christmas trees, stars, Santa Claus, stockings, or presents; and Hanukah, such as represented by menorahs.

In another embodiment of the present invention, the tiles are decorated in a way such that handicapped people can "read" the tiles.

The number on the tile can be any number. In one embodiment of the invention, the number is any number chosen from among: 0, 1, 2, 3, 4, 5, 6, 7, 8, 9, and 10. In another embodiment, the number is chosen from among any number between 0 and 100. In another embodiment, the number is chosen from among any number between 0 and 1000. In a further embodiment, the number is chosen from among any number between 0 and 10,000 or greater. In one embodiment, the number on the tile is in superscript, such as ("$^{2}$") or ("$^{3}$"), for example. In another embodiment, the number is in subscript. In a further embodiment, the number is neither in superscript nor subscript, that is, it is a regular number.

In one embodiment of the invention, the number is spelled out, such as "One," "Two," "Three," and so forth. In another embodiment, the numbers on each tile can include numbers in any language, such Chinese, for example.

The present invention includes tiles each of which contains a letter of an alphabet, such as from the alphabet "a" to the alphabet "z." The alphabet can also be in any language.

The present invention includes tiles that contain any symbol commonly used in mathematical equations, including, for example, a plus symbol ("+"), a minus symbol ("−"), a multiplication symbol represented by ("×") or an asterisk ("*"), a division symbol ("÷"), a square root symbol such as ("√"), a "log" notation, an open parenthesis ("("), a close parenthesis (")"), a first open bracket ("["), a first close bracket ("]"), a second open bracket ("{"), a second close bracket ("}"), a greater than symbol (">"), a smaller than symbol ("<"), an equal sign ("="), a percentage symbol ("%"), a dollar sign ("$"), a pound sign ("£"), a Euro sign ("€"), a Yen sign ("¥"), a cent sign ("¢"), an integration ("∫") sign, a degree ("°") sign, a plus and minus ("±") sign, a slash ("/"), a pi ("π") sign, a delta ("δ") sign, and the like.

The number, letter or symbol can be placed on the tile by any conventional means, such as by printing, pressing, inscribing, or carving such on the tile or by pouring of a mould. The number, symbol or letter can be flat, raised, depressed, painted or in color or not.

The tile can be made of any suitable stiff material, such as wood including pressed wood, laminated wood, paper including recycled paper, or cardboard, or metal, or alloy, or glass, or ceramic, or clay, or synthetic materials, such as plastic, or shells, or animal bone and the like. The material can be painted or stained or not.

The tile can be of any size. In one embodiment of the invention, the tile is made smaller for young children and larger for adults. It is of a size that is easy to handle or hold. For example, the size of the tile can be the same as the Mahjong tiles or the Rummikub tiles, a description of which can be easily found via the Internet, such as through a Google search. The tiles can be in the form of playing cards as well, and can be the same, smaller or larger than the conventional playing cards. In one embodiment of the invention, the tiles in the game set are all of the same size or same color. In another embodiment, the tiles are of different sizes or color. For example, the number or alphabet tiles can be in one color or of the same size, while the mathematical symbol tiles are of another color or size.

The tile can be of any shape. In one embodiment, the tile is of a square shape or a rectangular shape. In another embodiment, the tile is of a triangular shape or a circular shape. In a further embodiment, one set of tiles can be of one shape and another set of tiles can be of a different shape. For example, the numbers can be square or rectangular in shape, while the mathematical functions are triangular or circular in shape or vice versa, or any variations thereof.

The tile of the present invention can be of any suitable thickness. In one embodiment, the tile is relatively thin, such as less than ½ inch. In another embodiment, the tile is relatively thick, such as greater than ½ inch, such that each tile can stand on its own without any further support.

In one embodiment of the present invention, the game set includes a plurality of stands. Each stand is made to contain a plurality of tiles. For example, as a player picks a tile, the player will be able to place the tile on the stand so that the player can see the face of the tile, without having to hold onto the tile and without showing the tile to the other players. In one embodiment, the stand can contain at least about 10 tiles or 20 tiles, or 30 tiles or more.

In one embodiment of the invention, the stand will have a front surface, a back surface and a base. The front surface is indented to hold two or three levels of tiles. In one embodiment, the stand contains slots into which the tiles can be inserted. In another embodiment, the stand is tilted so that the tiles rest against the stand. The base is constructed so as to allow the stand to stay upright without further support.

The stand can be made of any suitable material, and can be made of the same material as the tile or not. For example, the stand can be made of wood, paper, particularly cardboard paper, metal, alloy, glass, ceramic, clay, plastic or other synthetic material or bone or the like.

The game set of the present invention optionally includes a timing device, such as an hour-glass, for example, timed for 1 minute, 2 minutes, 3 minutes, 4 minutes, or 5 minutes, for example.

In another embodiment, there is provided a set of instructions or rules for playing the game. The instructions will provide for how the game is to be played. It is to be understood that the game of the present invention can be played in a variety of ways, depending on the creativity of the players. Hence, the players may play the game according to the players' own rules. The instructions and rules will be considered as suggestions.

In one embodiment of the invention, the instructions include a purpose for the game. The purpose can be, for example, for each player to lay down full equations. Such full equations can be, for example, $1+1=2$, or $10-1=9$, or $2\times2=4$, or $8\div4=2$, or $(2\times2)^2=16$.

In another embodiment of the invention, the instructions provide that the first player to dispose of all of his or her tiles wins the game.

In another embodiment of the invention, the instructions provide that scores are to be kept. There are different ways to keep scores, again depending on the players' creativity or desire. For example, the result obtained by each equation can be a player's score, and the player can add up all the scores for all the equations the player laid down during the game. In yet another embodiment, the scores can relate to the number of mathematical symbols used in an equation, for example, one point each for each plus, minus, multiplication or division symbol used.

In a further embodiment, there is provided a plurality of sets of tiles as above, where each tile contains an alphabet. In one embodiment, such alphabet tile can be used in an algebraic equation, such as $(a+b)^2=a^2+2ab+b^2$. In this embodiment, the alphabet can be in any language.

The present invention optionally includes a container for holding the game set. The container can be made of any suitable materials. For example, the container can be simply a cardboard box. Optionally, the container can be a wooden box, a metal box, a glass box, a ceramic box, a clay box, a plastic box, a box made of animal bones or shells, or a box made of other synthetic materials, or a combination of such, as desired.

In one embodiment of the invention, the tiles each contain a small magnet such that the tiles can be played on a metal surface for ease of use while traveling.

In another embodiment, the game set includes, but is not limited to: twelve (12) tiles of each of the numbers, such as, 0, 1, 2, 3, 4, 5, 6, 7, 8 and 9 and of each of the mathematical symbols Optionally, the number of tiles for each number or symbol can vary between 4 and 20 or more, or between 6 and 18 or more, or between 8 and 16 or more, or between 10 and 14 or more.

In yet another embodiment, the game set contains a total of about 200 tiles, or about 210 tiles, or 212 tiles, or about 216 tiles, or about 220 tiles, or about 230 tiles, or 232 tiles.

In a variation of the invention, at least two mathematical symbols are placed on each symbol tile. The two symbols can be, for example, a plus symbol and a minus symbol, or a multiplication symbol and a division symbol. Such alternative symbols can be present on the same face of the tile or can be present in opposite faces of the tile, each tile having a first front surface and a second back surface.

In yet another embodiment of the invention, the invention includes a method of playing a game as above, where the method includes providing a game set and allowing the game to be played. In another embodiment, the method includes providing instructions or rules for playing the game.

In one embodiment of the invention, the game is played by each player taking turns laying down one or more equations during the player's turn. In a further embodiment of the invention, a player may re-arrange the equations that have been laid out by the players. In yet another embodiment, the players may be required to use all the tiles from one or more equations that are being re-arranged. In yet another embodiment, a player who does not have any tile to play during his or her turn may pick a tile from a pool.

In another embodiment of the invention, the game can be played at different levels of difficulty by removing or adding one or more mathematical functions. For example, a game can be played by using only addition functions, or only subtraction functions, or both while removing all the other functions. Optionally, multiplication functions can be included but not division functions. Still optionally, all mathematical functions can be included to increase the challenge.

In a further embodiment of the invention, the game can be played by the players have free access to the mathematical symbol as needed. Optionally, the players may access the mathematical symbols through picking from a mathematical symbol pool. Alternatively, each player may start with a set of mathematical symbols, with the requirement to pick from a pool when the initial set is exhausted.

In another embodiment, there is provided a software program, where the program is configured to provide the game set as above, and to allow the game to be played. The software can be provided on a computer disk or CD, or DVD, or an electronic medium such as a hand held device, for example, a Palm Pilot, a cell phone and the like. The game can be made accessible on the Internet.

The present invention includes a method of making a game set as above, the method includes carving the tiles out of wood or engineered wood or simulated wood, or providing a mould and pouring a tile-making material into the mould. The tile-making materials can be any suitable material conventional in making toys including for example, plastic, glass, metal, alloy, or other synthetic materials. Optionally, the tiles can be made in the form of playing cards, such as using cardboard paper, and the number, letter or symbol is then printed thereon.

The present invention includes a board for providing a playing surface. The board can be any conventional board made of any conventional materials for playing board games including, for example, a cardboard board. Optionally, the container for the game set can be partially unfolded to provide a playing surface such as those used for chess games.

While the present invention has been described with reference to the specific embodiments thereof, it should be understood by those skilled in the art that various changes may be made and equivalents may be substituted without departing from the true spirit and scope of the invention. In addition, many modifications can be made to adapt a particular situation, material, composition of matter, method or process steps to the objective, spirit and scope of the present invention. All such modifications are intended to be within the scope of the claims appended hereto.

What is claimed is:

1. A method of playing a mathematical game, comprising the steps of:

(a) providing a first set of tiles, wherein each tile comprises a number or an alphabet; and a second set of math tiles, wherein each math tile comprises a math symbol;

wherein the second set of math tiles comprises at least six math tiles each bearing a different math symbol, selected from the group consisting of: a plus ("+") a minus ("−"), a division symbol ("÷"), a multiplication symbol ("×"), an equal sign ("="), an open parenthesis ("("), a close parenthesis (")"), a first open bracket ("["), a first close bracket ("]"), a second open bracket ("{"), a second close bracket ("}"), a greater than symbol (">"), a smaller than symbol ("<"), a percentage symbol ("%"), a dollar sign ("$"), a pound sign ("£"), a Euro sign ("€"), a Yen sign ("¥"), a cent sign ("¢"), an integration ("∫") sign, a degree ("°") sign, a plus and minus ("+") sign, a slash sign ("/"), a pi ("π") sign, a delta ("δ") sign and a logarithmic sign ("log"), (b) providing instructions as to how the game is to be played;

wherein the instructions for playing the game comprises: (a) teaching each player to select a predetermined number of tiles; (b) teaching each player to lay down one or more equations during the player's turn or to rearrange an equation previously laid down using the predetermined number of tiles.

2. The method of claim 1, wherein the instructions further comprise teaching each player to pick a tile from a pool when the player is unable to lay down a tile during the player's turn.

3. The method of claim 1, wherein the instructions further comprise requiring each player who rearranges an equation to use all the tiles from that equation.

* * * * *